US010788045B2

(12) United States Patent
Fujiwara

(10) Patent No.: US 10,788,045 B2
(45) Date of Patent: Sep. 29, 2020

(54) DISCHARGE SECTION STRUCTURE FOR CENTRIFUGAL COMPRESSOR

(71) Applicant: IHI Corporation, Koto-ku (JP)

(72) Inventor: Takashi Fujiwara, Koto-ku (JP)

(73) Assignee: IHI Corporation, Koto-ku (JP)

( * ) Notice: Subject to any disclaimer, the term of this patent is extended or adjusted under 35 U.S.C. 154(b) by 179 days.

(21) Appl. No.: 16/060,070

(22) PCT Filed: Nov. 21, 2016

(86) PCT No.: PCT/JP2016/084491
§ 371 (c)(1),
(2) Date: Jun. 7, 2018

(87) PCT Pub. No.: WO2017/098911
PCT Pub. Date: Jun. 15, 2017

(65) Prior Publication Data

US 2018/0355886 A1 Dec. 13, 2018

(30) Foreign Application Priority Data

Dec. 10, 2015 (JP) ..... 2015-241125

(51) Int. Cl.
*F04D 29/42* (2006.01)
*F04D 29/44* (2006.01)
(Continued)

(52) U.S. Cl.
CPC ..... *F04D 29/422* (2013.01); *F04D 17/10* (2013.01); *F04D 29/4206* (2013.01); *F04D 29/441* (2013.01); *F02B 33/40* (2013.01)

(58) Field of Classification Search
CPC .. F04D 29/4206; F04D 29/441; F04D 29/442; F04D 29/4226
See application file for complete search history.

(56) References Cited

U.S. PATENT DOCUMENTS 3,824,028 A * 7/1974 Zenkner ..... F04D 29/4213 415/58.6
4,389,159 A * 6/1983 Sarvanne ..... F04D 29/445 415/206
(Continued)

FOREIGN PATENT DOCUMENTS

CN 1348065 A 5/2002
CN 101435437 A 5/2009
(Continued)

OTHER PUBLICATIONS

International Search Report dated Jan. 31, 2017 in PCT/JP2016/084491 citing references AA and AO therein, 1 page.

*Primary Examiner* — Justin D Seabe
(74) *Attorney, Agent, or Firm* — Oblon, McClelland, Maier & Neustadt, L.L.P.

(57) ABSTRACT

Provided is a discharge section structure for a centrifugal compressor provided with a scroll flow passage and a discharge flow passage connected to the scroll flow passage. The discharge section structure includes a tongue section provided in a branching section between the scroll flow passage and the discharge flow passage; a first flow passage section having a center of curvature on an origin side of the scroll flow passage; and a second flow passage section communicating with the first flow passage section and having a center of curvature on an outer side of the scroll flow passage. The first flow passage section includes at least a part of the scroll flow passage, and the second flow passage section includes at least a part of the discharge flow passage. The tongue section faces the second flow passage section and is located in the middle of the second flow passage section.

6 Claims, 10 Drawing Sheets

(51) Int. Cl.
*F04D 17/10* (2006.01)
*F02B 33/40* (2006.01)

(56) References Cited

U.S. PATENT DOCUMENTS 6,146,092 A * 11/2000 Botros ..... B60H 1/00471 415/119
2013/0266432 A1 10/2013 Iwakiri et al.

FOREIGN PATENT DOCUMENTS

| | | | |
|---|---|---|---|
| CN | 101514712 | A | 8/2009 |
| CN | 103261702 | A | 8/2013 |
| GB | 1 560 117 | A | 1/1980 |
| JP | 2002-266797 | A | 9/2002 |
| JP | 2005-207337 | A | 8/2005 |
| JP | 2012-219756 | A | 11/2012 |
| JP | 2013-104344 | A | 5/2013 |
| JP | 2015-10557 | A | 1/2015 |
| WO | WO 2012/140509 | A2 | 10/2012 |

* cited by examiner

DISCHARGE SECTION STRUCTURE FOR CENTRIFUGAL COMPRESSOR

TECHNICAL FIELD

The present disclosure relates to a discharge section structure for a centrifugal compressor.

BACKGROUND ART

From related art, various structures related to a compressor housing, such as scroll of a centrifugal compressor, have been studied. For example, as described in Patent Literature 1, in a compressor housing of a turbo supercharger, a spiral scroll having a tongue section as a starting point, a cross-sectional area gradually increasing in a clockwise direction, and leading to a discharge tube is known. The tongue section is formed at a branching point between the scroll and the discharge tube. In this structure, the tongue section is defined as a starting point and an ending point of the scroll, and by setting the starting point at 0° to take an angle clockwise and by setting 360° as the ending point, the scroll is ended at this position. The portion subsequent to the ending point of the scroll is a discharge tube.

CITATION LIST

Patent Literature

Patent Literature 1: Japanese Unexamined Patent Publication No. 2005-207337

SUMMARY OF INVENTION

Technical Problem

In the compressor housing of the related art, in many cases, the shape of the discharge section was configured to be straight. In a case where the discharge section is configured in a straight shape, a loss due to collision of flow tends to occur on a side of a larger flow rate than the flow rate producing peak efficiency. As a result, a reduction in efficiency occurs.

The present disclosure describes a structure of a discharge section of a centrifugal compressor capable of suppressing reduction in efficiency in a discharge section.

Solution to Problem

The inventor repeatedly conducted extensive studies on generating factors of the loss due to collision of flow and the remedial measures thereof in a scroll flow passage or a discharge flow passage. As a result, the inventor has found that the aforementioned problem can be solved by devising the shape of the discharge flow passage and the position of the tongue section with respect to the shape of the discharge flow passage. That is, in the conventional discharge section configured in a straight shape, it was found that a loss was generated due to, for example, collision of the flow from the diffuser or the like with the tongue section.

An aspect of the present disclosure is a discharge section structure for a centrifugal compressor provided with a scroll flow passage and a discharge flow passage connected to a discharge side of the scroll flow passage. The discharge section structure includes a tongue section provided in a branching section between the scroll flow passage and the discharge flow passage; a first flow passage section having a center of curvature on an origin side of the scroll flow passage; and a second flow passage section communicating with the discharge side of the first flow passage section and having a center of curvature on an outer side of the scroll flow passage. The first flow passage section includes at least a part of the scroll flow passage, the second flow passage section includes at least a part of the discharge flow passage, and the tongue section faces the second flow passage section and is located in the middle of the second flow passage section.

Effects of Invention

According to an embodiment of the present disclosure, it is possible to suppress the flow of gas from colliding with the tongue section. As a result, it is possible to reduce the loss and to suppress the decrease in efficiency of the discharge section.

DESCRIPTION OF EMBODIMENTS

Figure 1:
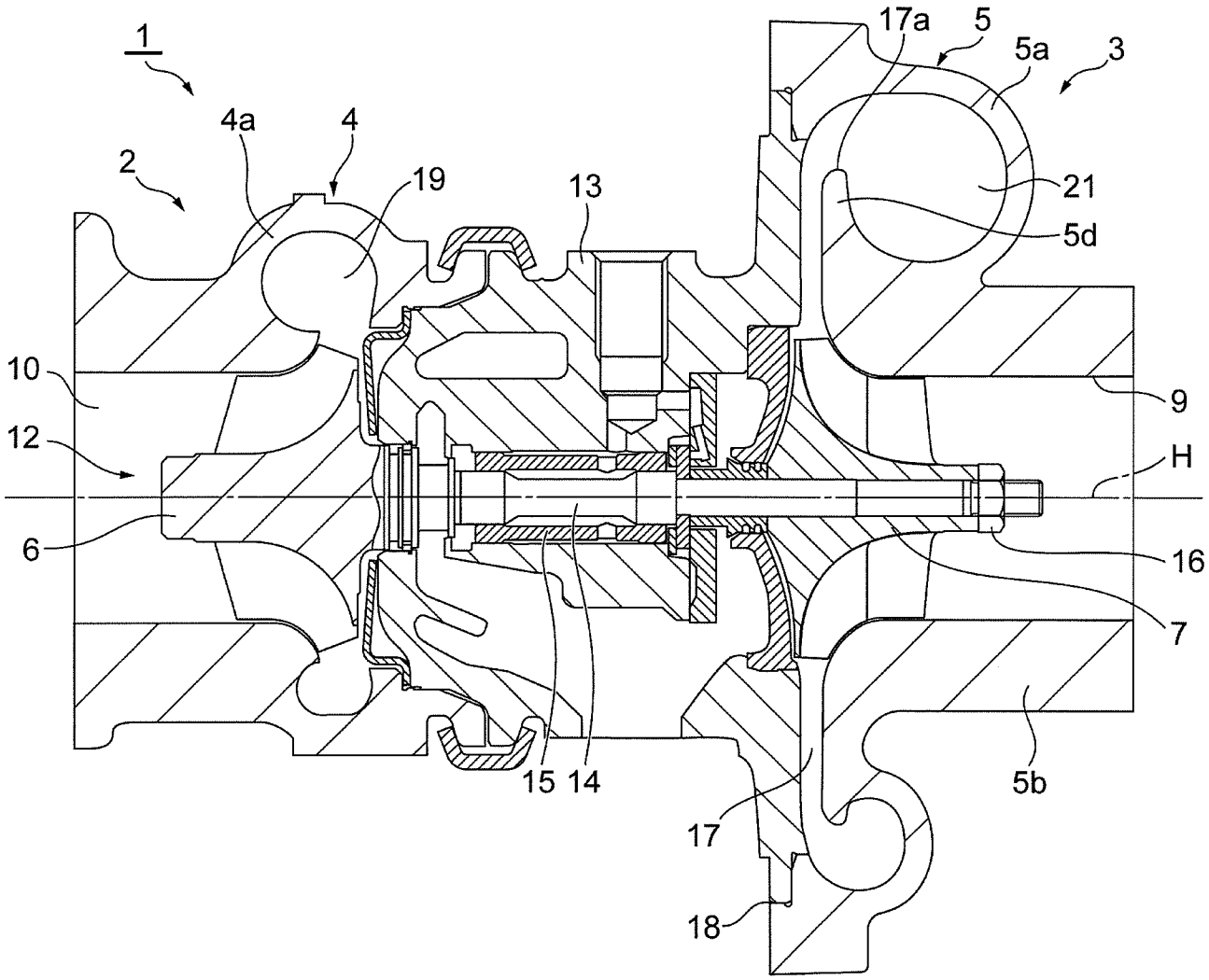
FIG. 1 is a cross-sectional view of a turbocharger including a compressor to which an embodiment of the present disclosure is applied.

An aspect of the present disclosure is a discharge section structure for a centrifugal compressor provided with a scroll flow passage and a discharge flow passage connected to a discharge side of the scroll flow passage. The discharge section structure includes a tongue section provided in a branching section between the scroll flow passage and the discharge flow passage, a first flow passage section having a center of curvature on an origin side of the scroll flow passage, and a second flow passage section communicating with the discharge side of the first flow passage section and having a center of curvature on an outer side of the scroll flow passage. The first flow passage section includes at least a part of the scroll flow passage, the second flow passage section includes at least a part of the discharge flow passage, and the tongue section faces the second flow passage section and is located in the middle of the second flow passage section.

According to the discharge section structure for the centrifugal compressor, the second flow passage section including at least a part of the discharge flow passage has the center of curvature on the outer side of the scroll flow passage. That is, a curved direction of the second flow passage section is opposite to that of the first flow passage section having the center of curvature on the origin side of the scroll flow passage. The tongue section facing the second flow passage section is located in the middle of the second flow passage section. Since the tongue section is provided in the middle of the second flow passage section that curves outward as described above, the tongue section is located on the outer circumference side of the second flow passage section that forms a curve. Therefore, as compared with a case where the discharge flow passage is straight, the tongue section is located far from the flow, and the flow is hard to collide with the tongue section. Loss can be reduced by the positional relation between the discharge flow passage having such a curved shape and the tongue section. As a result, reduction in efficiency in the discharge section is suppressed.

In some embodiments, the tongue section may be located at a central portion of the second flow passage section or on a downstream side of the central portion. According to this configuration, the position of the tongue section becomes farther, and the aforementioned effect can be exhibited more remarkably.

In some embodiments, in a cross section orthogonal to the central axis passing through the origin of the scroll flow passage, an angle formed between a wall surface of the tongue section on the scroll flow passage side and a wall surface of the tongue section on the discharge flow passage side may be 50° or more.

Hereinafter, an embodiment of the present disclosure will be described with reference to the drawings. In the description of the drawings, the same elements are denoted by the same reference numerals, and the repeated description will not be provided. In the present embodiment, in the case of using the terms "upstream" or "downstream", the terms are based on the flow direction of the gas.

A turbocharger 1 to which the discharge section structure for the present embodiment is applied will be described with reference to FIG. 1. As illustrated in FIG. 1, a turbocharger 1 is applied to, for example, an internal combustion engine of a ship or a vehicle. The turbocharger 1 includes a turbine 2 and a compressor (a centrifugal compressor) 3. The turbine 2 includes a turbine housing 4, and a turbine wheel 6 housed in the turbine housing 4. The turbine housing 4 has a scroll section 4*a* extending in a circumferential direction at an inner circumferential edge portion. The compressor 3 includes a compressor housing 5, and a compressor wheel 7 housed in the compressor housing 5. The compressor housing 5 has a scroll section 5*a* extending in the circumferential direction at the inner circumferential edge portion.

The turbine wheel 6 is provided at one end of a rotary shaft 14, and the compressor wheel 7 is provided at the other end of the rotary shaft 14. The compressor wheel 7 is fixed to the rotary shaft 14 by a nut 16 provided at the other end of the rotary shaft 14. A bearing housing 13 is provided between the turbine housing 4 and the compressor housing 5. The rotary shaft 14 is rotatably supported by the bearing housing 13 via a journal bearing 15. The rotary shaft 14, the turbine wheel 6, and the compressor wheel 7 rotate around the rotary axis H as an integral rotating body 12.

An exhaust gas inlet port (not illustrated) and an exhaust gas outlet port 10 is provided in the turbine housing 4. The exhaust gas (fluid) discharged from an internal combustion engine (not illustrated) flows into the turbine housing 4 through the exhaust gas inlet port, and flows into the turbine wheel 6 through the scroll flow passage 19 in the scroll section 4*a*, thereby rotating the turbine wheel 6. Thereafter, the exhaust gas flows out of the turbine housing 4 through the exhaust gas outlet port 10.

Figure 2:
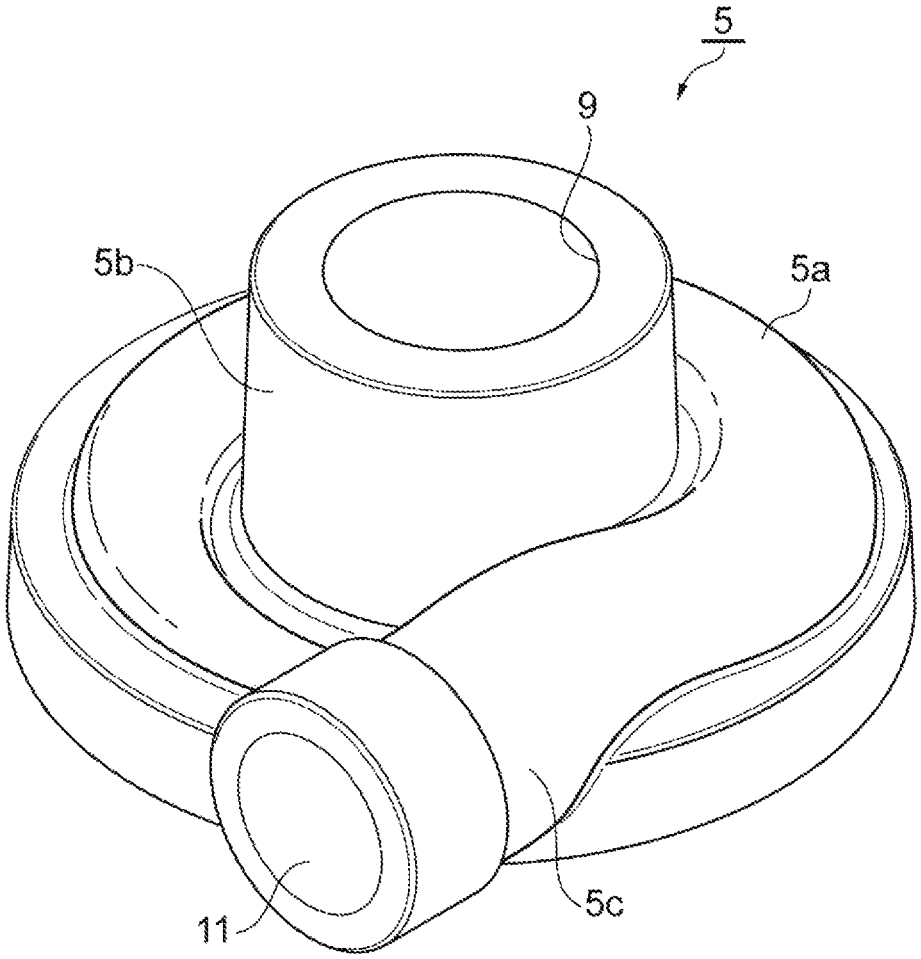
FIG. 2 is a perspective view of the compressor housing in FIG. 1.

A suction port 9 and a discharge port 11 are provided in the compressor housing 5 (see FIG. 2). When the turbine wheel 6 rotates as described above, the compressor wheel 7 rotates via the rotary shaft 14. The rotating compressor wheel 7 sucks and compresses outside air through the suction port 9, and discharges the outside air from the discharge port through the scroll flow passage 21 in the scroll section 5*a*. The compressed air discharged from the discharge port 11 is supplied to the aforementioned internal combustion engine.

Next, the compressor housing 5 to which the discharge section structure of this embodiment is applied will be described with reference to FIGS. 2 to 4. As illustrated in FIG. 2, the compressor housing 5 includes a spiral scroll section 5*a*, a cylindrical suction tube 5*b* provided at the center of the scroll section 5*a*, and a discharge tube 5*c* connected to the scroll section 5*a* and including the aforementioned discharge port 11. Since the compressor housing 5 includes a novel compressed gas flow passage 20 inside, it is possible to reduce the loss of flow particularly at a large flow rate and to promote an improvement in the efficiency. In particular, in the compressor housing 5, the shape of the internal flow passage from the scroll section 5*a* to the discharge tube 5*c* is characterized.

Figure 3:
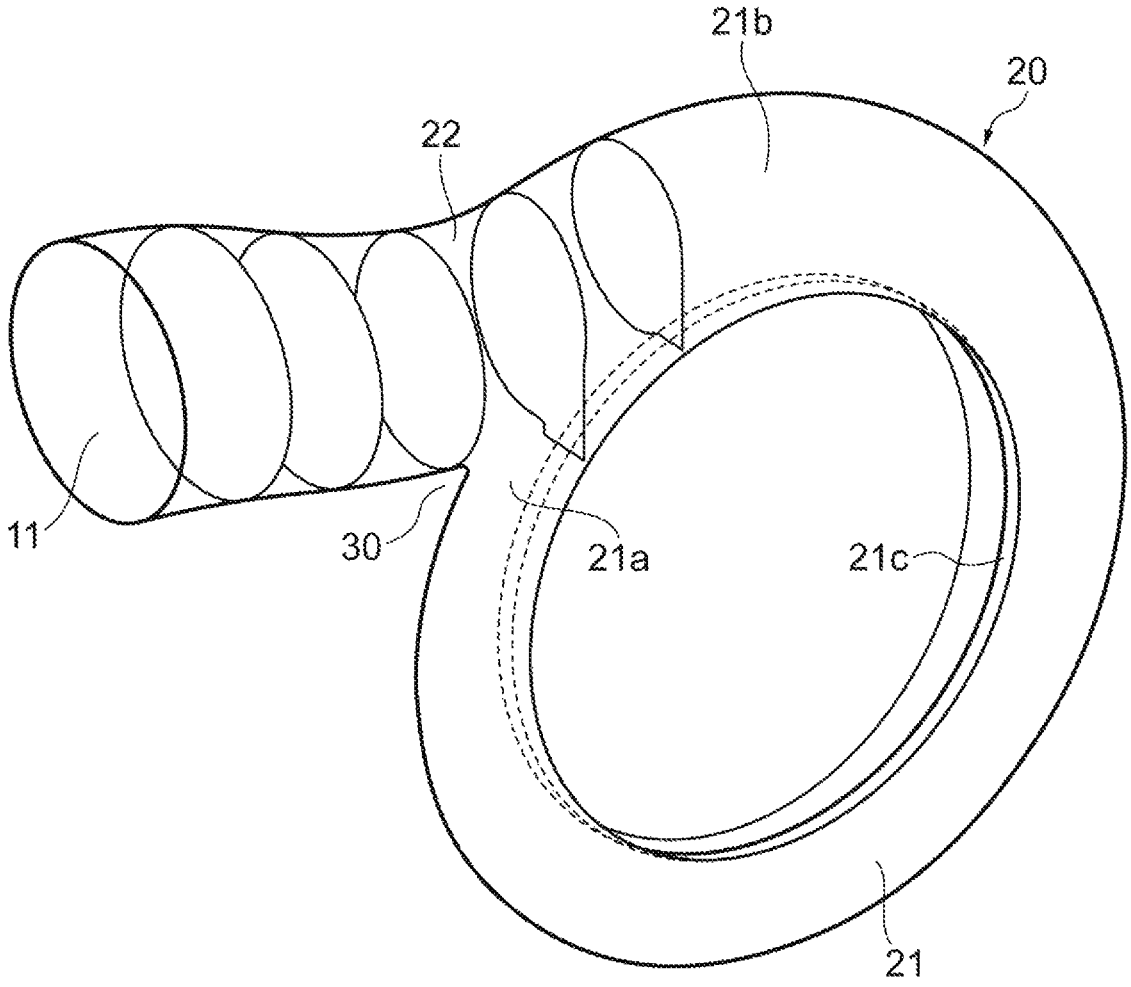
FIG. 3 is a perspective view illustrating an external form of a compressed gas flow passage.

FIG. 3 is a perspective view illustrating an external form of the compressed gas flow passage 20. FIG. 4 is a diagram illustrating the external form of the compressed gas flow passage 20, and for example, is a cross-sectional view taken along a plane orthogonal to the rotary axis H (central axis) passing through an origin C of the scroll flow passage 21. As illustrated in FIG. 3, the compressed gas flow passage 20 provided in the compressor housing 5 includes a spiral scroll flow passage 21, and a discharge flow passage 22 connected to the discharge side of the scroll flow passage 21. Here, the external form of the compressed gas flow passage 20 is, for example, a curve that connects a position (referred to as an outermost circumferential portion) at which the outer wall surface of each flow passage cross section is the maximum in a radial direction and a position (referred to as an innermost circumferential portion) at which the inner wall surface is the minimum in the radial direction. A height (a length from a bottom surface of the compressor housing 5 perpendicular to the rotary axis H) of the outermost circumferential portion and the innermost circumferential portion in the direction of the rotary axis H is not necessarily the same. In this case, for example, even when the height in the direction of the rotary axis H is different, on the plane orthogonal to the rotary axis H passing through the origin C, the outermost circumferential portion and the innermost circumferential portion are projected in the direction of the rotary axis H, and the projected outer circumferential line and the inner circumferential line may be regarded as the external form of the compressed gas flow passage 20. The air sent by the compressor wheel 7 is collected in the compressed gas flow passage 20 via the diffuser 17 (sec FIG. 5B) and discharged from the discharge port 11. The annular diffuser 17 is a parallel flow passage having a constant height in the direction of the rotary axis H. The diffuser 17 is provided between a space in which the compressor wheel 7 is disposed and the compressed gas flow passage 20 to allow them communicate with each other. An annular diffuser outlet port 21*c* appears on the inner circumferential side of the compressed gas flow passage 20. The origin C of the scroll flow passage 21 is, for example, a point which serves as a reference of the radial distance from the rotary axis H of the inner wall section 23 or the outer wall section 24 of each flow passage cross section in the scroll flow passage 21. In this case, the rotary axis H passes through the origin C. The rotary axis H can be determined, for example, on the basis of a structure of the compressor housing 5 or a fitting structure between the compressor housing 5 and the bearing housing 13 (see FIG. 1). The rotary axis H may be an axial center of the inner circumferential surface of the suction tube 5*b* (that is, the suction port 9). The rotary axis H may be an axial center of a front end portion on the outer circumferential side of the wall section 5*d* (the wall section facing the scroll flow passage 21) of the compressor housing 5 forming the diffuser 17, that is, the outer circumferential edge 17*a* of the diffuser 17. The rotary axis H may be an axial center of the fitting section 18 between the compressor housing 5 and the bearing housing 13. When each of the inner circumferential surface of the suction tube 5*b*, the outer circumferential edge 17*a* of the diffuser 17, and the fitting section 18 has a circular shape, as described above, the rotary axis H can be the axial center (center). When the inner circumferential surface of the suction tube 5*b*, the outer circumferential edge 17*a* of the diffuser 17, and the fitting section 18 do not have a circular shape (when they are not perfect circles), the rotary axis H may be the area center thereof.

Figure 4:
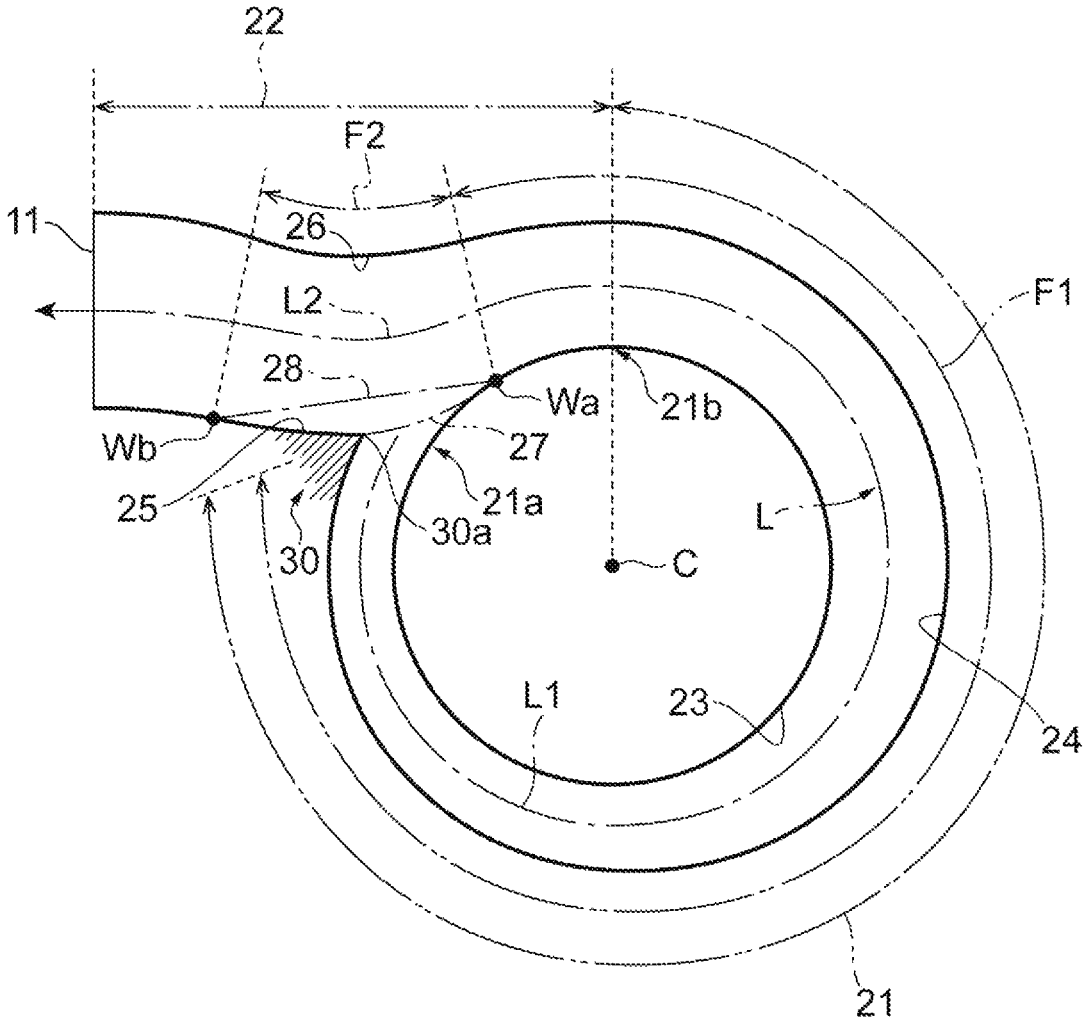
FIG. 4 is a diagram illustrating an external form of a compressed gas flow passage, and is a cross-sectional view taken along a plane orthogonal to a central axis passing through the origin.

As illustrated in FIGS. 2 to 4, a tongue section 30 is provided at the branching section between the scroll flow passage 21 and the discharge flow passage 22. A section from a winding start section 21*a* corresponding to the tongue section 30 to a winding finish section 21*b* is the scroll flow passage 21 in the compressed gas flow passage 20. More specifically, an angle in the circumferential direction from the winding start section 21*a* to the winding finish section 21*b* is, for example, about 300°. The invention is not limited to this aspect, and the angle in the circumferential direction from the winding start section 21*a* to the winding finish section 21*b* may be less than 300° or may be 300° or more. The range of the scroll flow passage 21 can vary depending on the shape of the discharge tube 5*c*, the position of the discharge port 11, the designing method, and the like. The scroll flow passage 21 may be continuous over one cycle (that is, 360°).

Figure 5A:
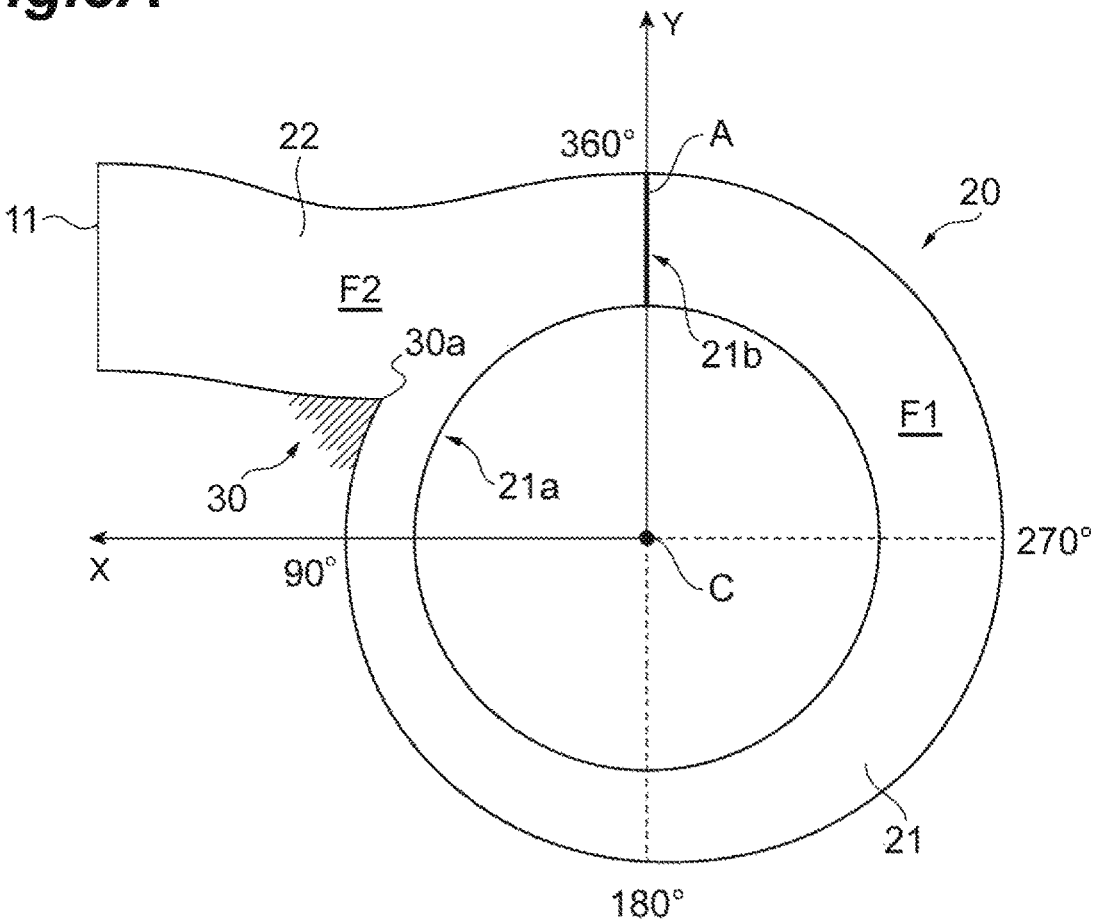
FIG. 5A is a diagram illustrating a relation between a winding finish section and the tongue section.
Figure 5B:
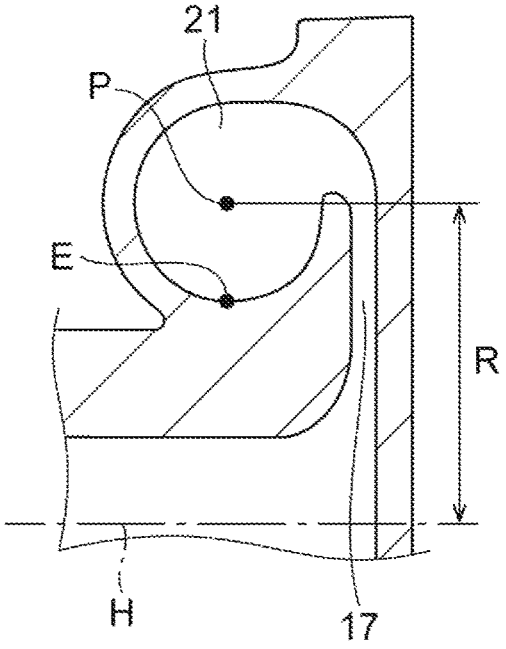
FIG. 5B is a cross-sectional view of the flow passage taken along the plane including the central axis.

In the present embodiment, the scroll flow passage 21 starts at the position corresponding to the tongue section 30, and the scroll flow passage 21 ends at the position of the representative cross section A (see FIG. 5A). The flow passage continued to the scroll flow passage 21 is the above-described discharge flow passage 22. The discharge flow passage 22 may have any shape or size as the position or shape of the discharge port 11 is changed depending on the usage form of the turbocharger 1. The shapes of the scroll flow passage 21 and the discharge flow passage 22 are determined so that efficiency is enhanced with respect to the predetermined discharge port 11.

As illustrated in FIG. 4, the compressed gas flow passage 20 has a second flow passage section F2 of a shape curved outward within the range of the discharge flow passage 22. That is, the compressed gas flow passage 20 has a first flow passage section F1 having a center of curvature on the origin C side (in other words, the inner side), and a second flow passage section F2 which is provided so as to be continuous with the first flow passage section F1 and has a center of curvature on the outer side on the scroll flow passage 21.

Here, the curvature of each flow passage section is, for example, determined by the curve which connects the centers of the cross section (center of gravity or centroid, see the center P of FIG. 5B), when cutting the compressed gas flow passage 20 on the plane passing through the origin C. The curve connecting the centers is not necessarily positioned on the same plane. For example, the curve connecting the centers may be projected in the axial direction passing through the origin C, and the curvature of each flow passage section may be calculated on the basis of the center line L projected on a plane orthogonal to the axis.

The curvature of each flow passage section may be determined on the basis of the portion closest to the origin C of the cross section (see the inner end E of FIG. 5B), without being limited to a case where the curvature is determined by the center of the cross section. In contrast, the curvature of each flow passage section may be determined on the basis of the farthest portion from the origin C.

The curvature of each flow passage section may vary depending on the location. In the compressed gas flow passage 20, the first flow passage section F1 and the second flow passage section F2 are determined depending on whether the center of the curvature is located inside or outside the scroll flow passage 21. The above-described center line L includes a first center line L1 corresponding to the first flow passage section F1, and a second center line L2 corresponding to the second flow passage section F2. The center of the curvature of the first center line L1 is located inside the scroll flow passage 21, and the center of the curvature of the second center line L2 is located outside the scroll flow passage 21. That is, the curvature varies between the first flow passage section F1 and the second flow passage section F2 (an inflection point exists).

The first flow passage section F1 includes an inner wall section 23 which roughly constitutes the inner circumferential side of the scroll flow passage 21, and an outer wall section 24 which roughly constitutes the outer circumferential side of the scroll flow passage 21. The second flow passage section F2 includes an outer wall section 25 which roughly constitutes the outer circumferential side of the discharge flow passage 22, and an inner wall section 26 which roughly constitutes the inner circumferential side of the discharge flow passage 22. The outer wall section 24 is continuous with the inner wall section 26. The tongue section 30 is provided between the outer wall section 24 and the outer wall section 25.

The scroll flow passage 21 and the first flow passage section F1 may be in a coincident range or may be in different ranges. Even when the scroll flow passage 21 and the first flow passage section F1 are in the different ranges, the scroll flow passage 21 and the first flow passage section F1 partially overlap each other. The discharge flow passage 22 and the second flow passage section F2 may be in the coincident range or may be in different ranges. Even when the discharge flow passage 22 and the second flow passage section F2 are in the different ranges, the discharge flow passage 22 and the second flow passage section F2 partially overlap each other. In other words, the first flow passage section F1 includes at least a part of the scroll flow passage 21. The second flow passage section F2 includes at least a part of the discharge flow passage 22.

For example, in the example illustrated in FIG. 4, one ending points (ending points on the upstream side) of the scroll flow passage 21 and the first flow passage section F1 coincide with the other, and the other ending points (ending points on the downstream side) do not coincide with each other. Regarding the discharge flow passage 22 and the second flow passage section F2, neither one ending point (ending point on the upstream side) nor the other ending point (ending point on the downstream side) coincides with each other.

In such a compressed gas flow passage 20, the tongue section 30 is located in the middle of the second flow passage section F2 curved outward. The tongue section 30 faces the second flow passage section F2 (that is, opposite to the second flow passage section F2). In other words, the second flow passage section F2 includes the position of the tongue section 30. The discharge flow passage 22 also includes the position of the tongue section 30.

More specifically, the tongue section 30 is located at the central portion of the second flow passage section F2. As described above, since the second flow passage section F2 is curved outward, the outer circumferential portion of the curve is formed by the outer wall section 25. The inner wall section 23 of the first flow passage section F1 and the outer wall section 25 of the second flow passage section F2 are not continuous in the region the tongue section 30 is facing, but there is a space between them. However, it is possible to assume an imaginary surface 27 which smoothly connects the inner wall section 23 and the outer wall section 25. A convex shaped wall section of the second flow passage section F2 is formed by the imaginary surface 27 and the outer wall section 25. Since the end portion on the upstream side of the outer wall section 25 is the front end 30*a* of the tongue section 30, the imaginary surface 27 passes through the front end 30*a*.

The tongue section 30 is located at the central portion of the convex shaped wall section. The tongue section 30 may be located on the upstream side of the convex shaped wall section or may be located on the downstream side thereof. At least the tongue section 30 is located on the side closer to the outer circumferential than the imaginary line 28 (in FIG. 4, below the imaginary line 28) which connects the outer circumferential wall section Wa of the starting point of the second flow passage section F2 and the outer circumferential wall section Wb of the ending point of the second flow passage section F2. In other words, the discharge flow passage 22 exists at a position along the curved shape, but when considering the conventional straight discharge section shape as a standard, the discharge flow passage 22 exists at a more retracted position. The tongue section 30 may be located on the downstream side of the central portion of the second flow passage section F2.

Further, features of the tongue section 30 will be described from a different point of view. In a cross section orthogonal to the central axis passing through the origin C, an angle formed between the outer wall section 24 which is the wall surface of the tongue section 30 on the side of the scroll flow passage 21, and the outer wall section 25 which is the wall surface of the tongue section 30 on the discharge flow passage 22 side (the outer wall sections intersect with each other at the front end 30*a*) is 50° or more. The angle of the tongue section 30 may be 30° or more and less than 50°, and may be 50° or more.

Further, from another point of view, the compressed gas flow passage 20 can also be explained as follows. Here, a plane perpendicular to the straight line which connects the center of the radius of curvature of the scroll flow passage 21 and the front end 30*a* of the tongue section 30 is assumed. For example, this plane may be considered as a perpendicular bisector between the aforementioned two points. The center of the radius of curvature of the discharge flow passage 22 at the position of the tongue section 30 is located on the opposite side of the center of the radius of curvature of the scroll flow passage 21 across the plane. Such a feature means the same technical matters as the above-described second flow passage section F2.

Subsequently, features of the compressed gas flow passage 20 based on the representative cross section A will be described with reference to FIG. 5. As illustrated in FIG. 5A, in the compressed gas flow passage 20, a representative cross section A is taken as a cross section of a position of 360°. The representative cross section A is a cross section that is located at a position shifted upward by several tens of degrees (for example, 30 to 60°) from the tongue section 30 on the basis of the discharge flow passage 22. The representative cross section A may be a cross section that is located at a position shifted by 50° or 60° to the upstream side of the tongue section 30 on the basis of the discharge flow passage 22.

Figure 7A:
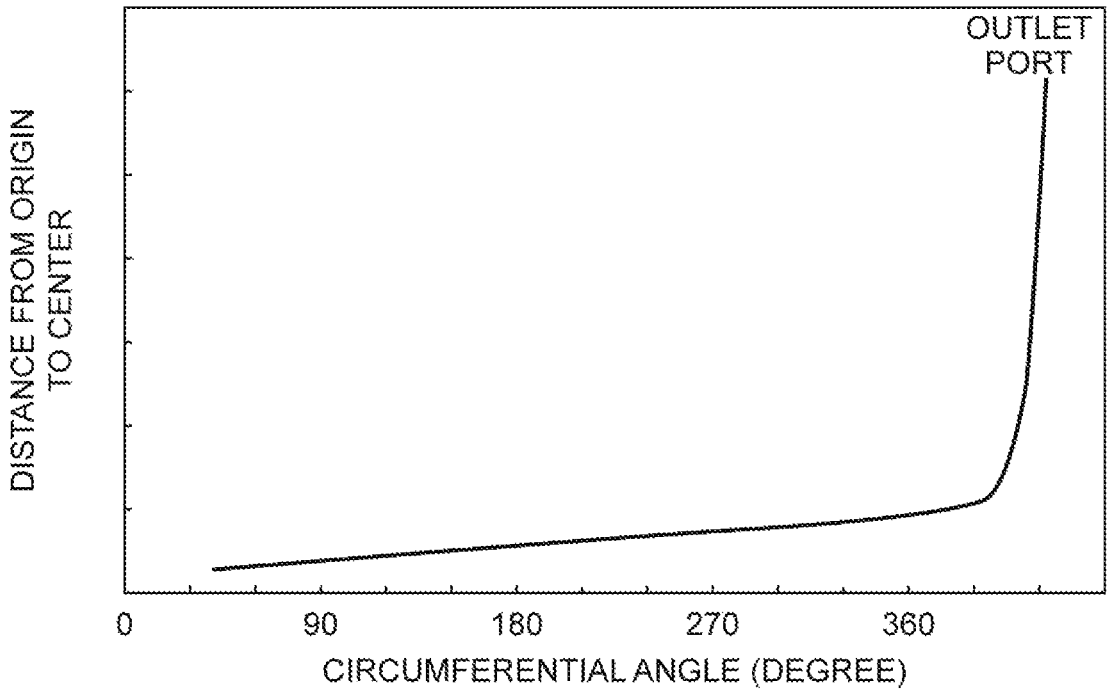
FIG. 7A is a diagram illustrating a relation between an angle in the circumferential direction and a distance from the origin to the flow passage center.
Figure 7B:
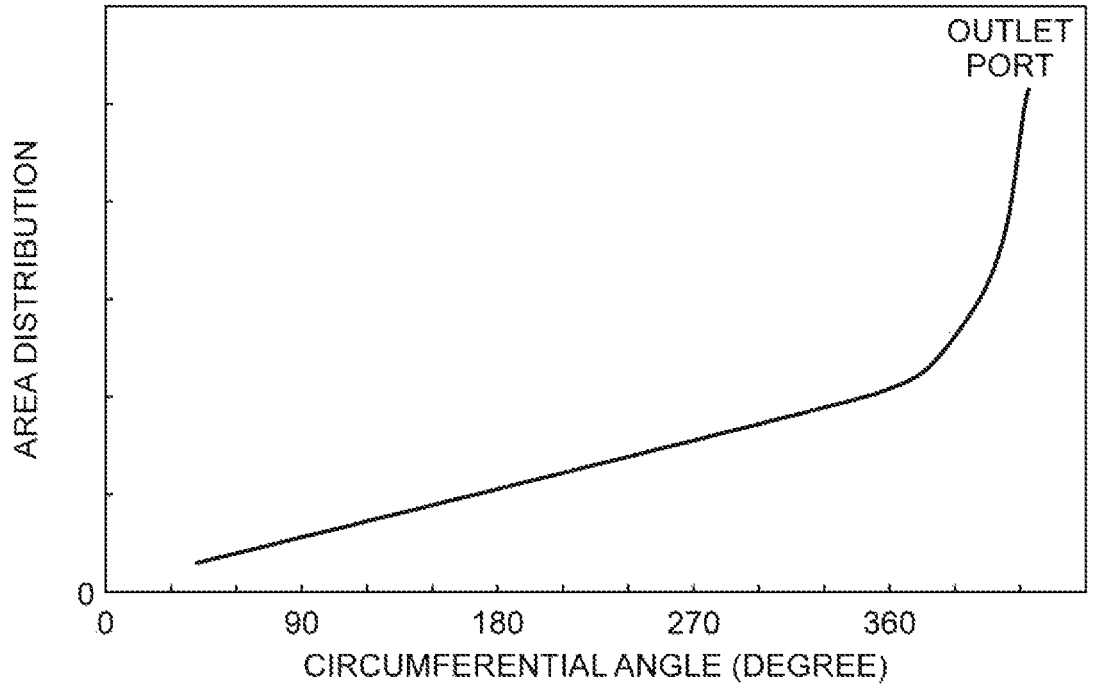
FIG. 7B is a diagram illustrating a relation between the angle in the circumferential direction and the cross-sectional area of the flow passage.

An example of the representative cross section A will be described. As illustrated in FIG. 7A, a final region in which the distance R (see FIG. 5B) from the origin C to the center P of the compressed gas flow passage 20 increases with a substantially constant inclination, may be the representative cross section A. On the other hand, as illustrated in FIG. 7B, the final region in which the cross sectional area of the compressed gas flow passage 20 increases with a substantially constant inclination may be the representative cross section A. For example, the representative cross section A may be a cross section at any position in the range of 360 to 390° in the angle in the circumferential direction. The representative cross section A may be a cross section of the position of 360° in the angle in the circumferential direction.

Figure 6:
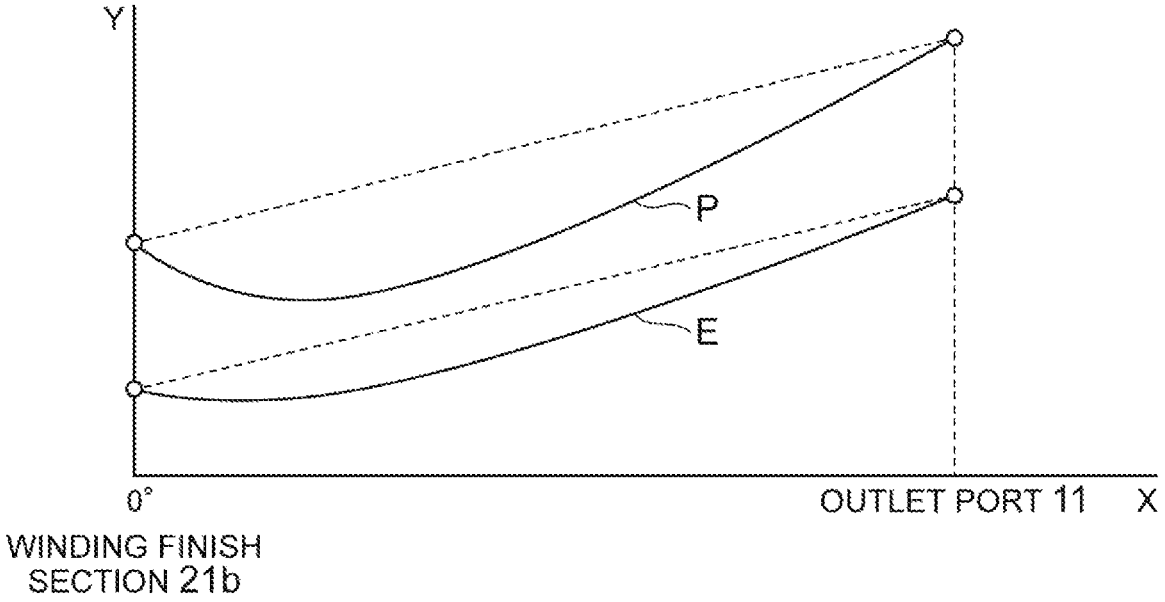
FIG. 6 is a diagram illustrating a flow passage shape from the winding finish section to the discharge flow passage.

In the compressed gas flow passage 20, the direction which connects the origin C and the representative cross section A is defined as a Y-axis direction, and the direction orthogonal to the plane including the origin C and the representative cross section A is defined as a X-axis direction. In this case, as illustrated in FIG. 6, when looking at the change tendency of the value in the Y direction to the X direction after the winding finish section 21*b* corresponding to the representative cross section A, the distance from the X-axis to the center P of the flow passage cross section, and the distance from the X-axis to the inner end E which is a portion closest to the X-axis have a shape protruding downward.

According to the discharge section structure of related art, in many cases, the straight flow passage shape was often formed from the winding finish section 21*b* toward the discharge port 11. That is, as illustrated by a broken line in FIG. 6, a linear shape was often obtained. In contrast, in the compressed gas flow passage 20 of the present embodiment, a flow passage has a downward protruding shape. This feature means the same technical matters as the above-described second flow passage section F2.

Figure 8A:
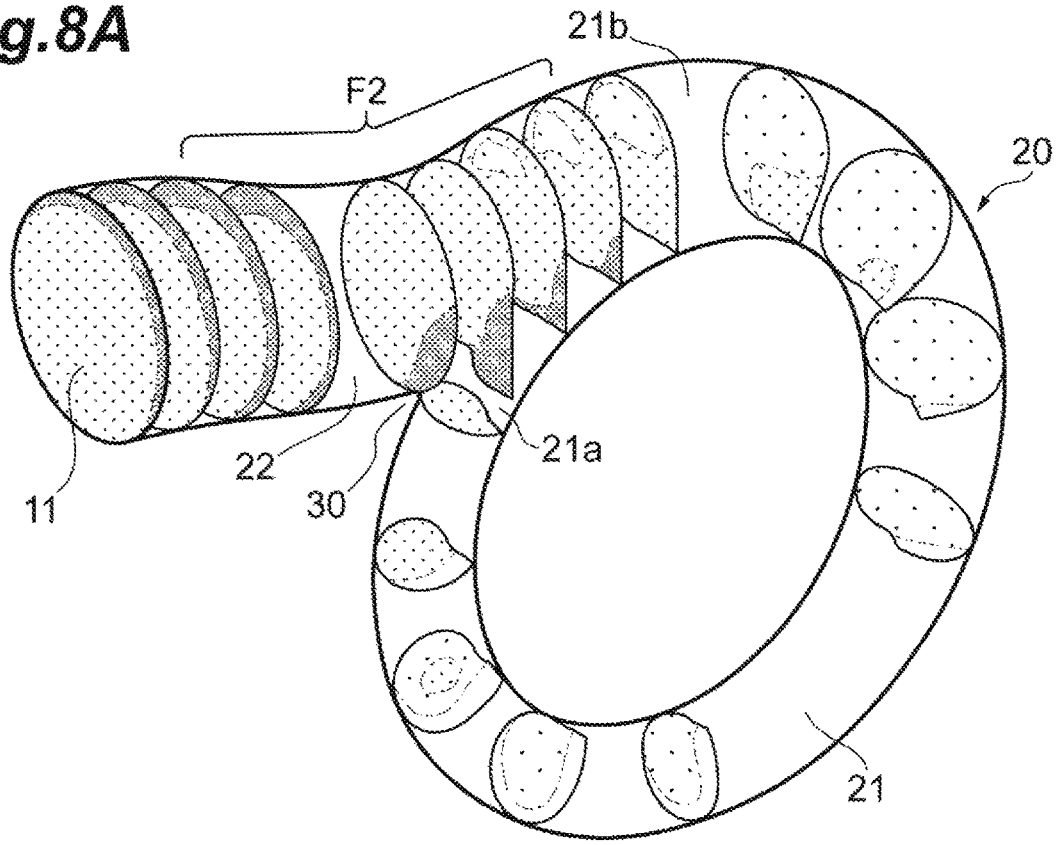
FIG. 8A is a diagram illustrating a total pressure distribution in the discharge section structure for the present embodiment illustrated in FIG. 3.
Figure 8B:
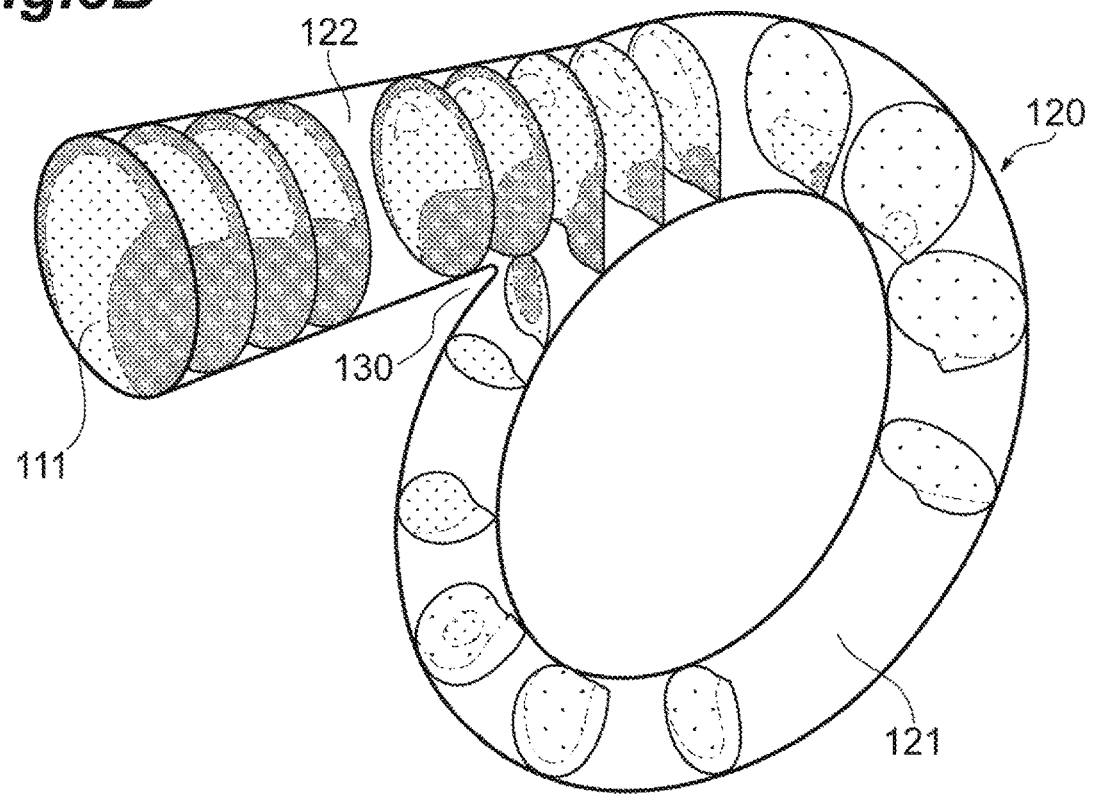
FIG. 8B is a diagram illustrating a total pressure distribution in a discharge section structure of a comparative example illustrated in FIG. 9.

The discharge section structure of the compressor housing 5 and the conventional discharge section structure described above were evaluated by fluid analysis, and the following results were obtained. FIG. 8A is a diagram illustrating the total pressure distribution in the discharge section structure for the present embodiment, and FIG. 8B is a diagram illustrating the total pressure distribution in the discharge section structure of the comparative example illustrated in FIG. 9. In this figure, the total pressure in the flow passage is indicated by shading. In other words, the total pressure is higher for areas that are displayed thinner, and the total pressure is lower for areas that are displayed darker.

In the compressed gas flow passage 20 according to the present embodiment, it is understood that the reduction in total pressure is suppressed in the second flow passage section F2.

Figure 9:
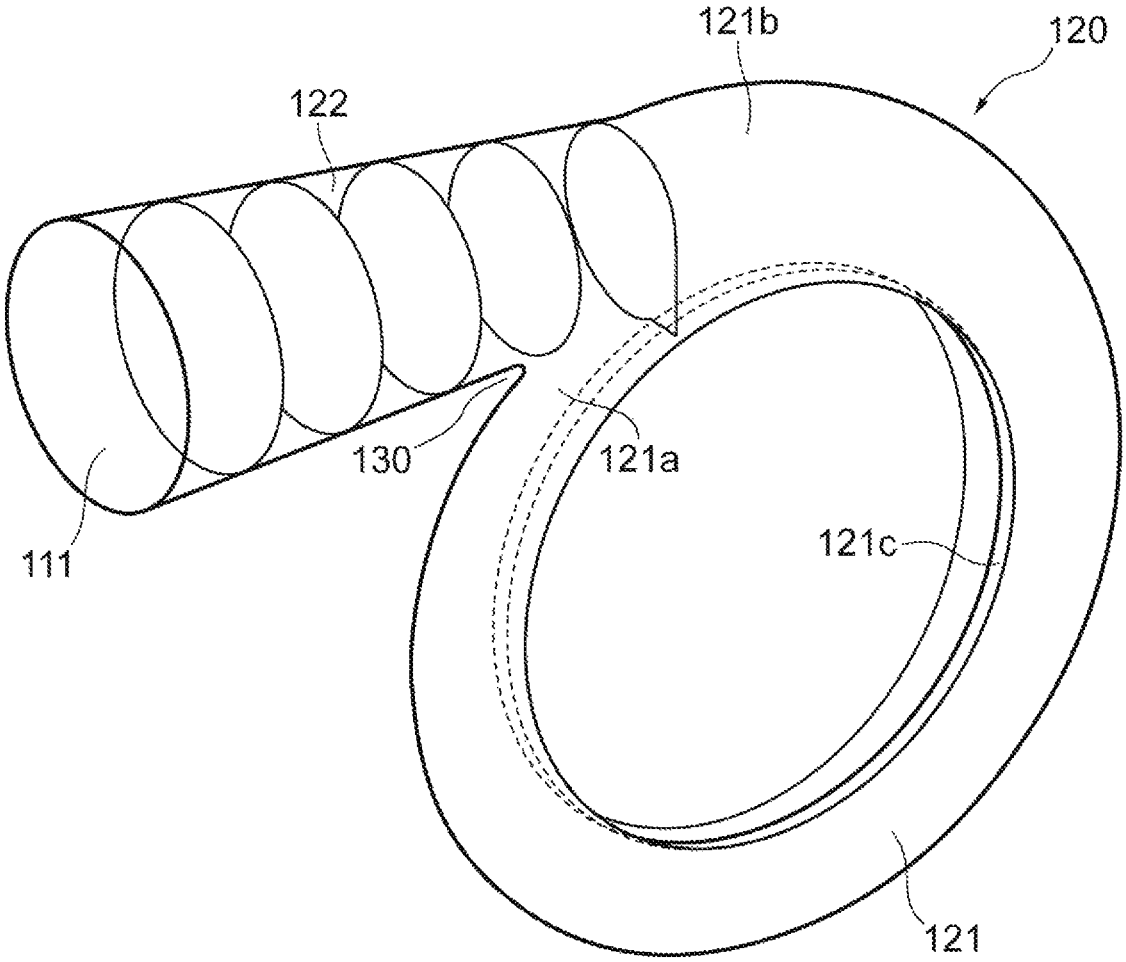
FIG. 9 is a perspective view illustrating an external form of a compressed gas flow passage according to a comparative example.

The conventional compressed gas flow passage 120 illustrated in FIG. 9 includes a scroll flow passage 121 and a discharge flow passage 122, and the discharge flow passage 122 has a straight shape. The shape of the flow passage from the winding start section 121*a* to the winding finish section 121*b*, the thickness of the diffuser outlet port 121*c*, and the like are not largely different from those of the compressed gas flow passage 20 of the present embodiment, but the position and shape of the tongue section 130 are different. That is, the tongue section 130 is located at a high position in the Y direction with respect to the winding finish section 121*b*. It is needless to say that the second flow passage section F2 is not formed in the compressed gas flow passage 120.

As illustrated in FIG. 8B, in the compressed gas flow passage 120, the flow from the diffuser outlet port 121*c* collides with the tongue section 130, and the total pressure lowers in a wide range around the tongue section 130. As a result, a loss occurs in the discharge port 111.

From the above, the effectiveness of the compressed gas flow passage 20 in the efficiency aspect was checked.

According to the discharge section structure of the compressor 3 described above, the second flow passage section F2 including at least a part of the discharge flow passage 22 has the center of curvature on the outer side of the scroll flow passage 21. That is, the curved direction of the second flow passage section F2 is opposite to that of the first flow passage section F1 having the center of curvature on the origin C side of the scroll flow passage 21. The tongue section 30 facing the second flow passage section F2 is located in the middle of the second flow passage section F2. Since the tongue section 30 is provided in the middle of the second flow passage section F2 that curves outward as described above, the tongue section 30 is located on the outer circumference side of the second flow passage section F2 that forms a curve. Therefore, as compared with a case where the discharge flow passage 22 is straight, the tongue section 30 is located far from the flow, and the flow is hard to collide with the tongue section 30. Due to the positional relation between the discharge flow passage 22 having such a curved shape and the tongue section 30, the loss is reduced. As a result, reduction in efficiency at the discharge port 11 is suppressed. This effect is particularly effectively exhibited on the side of the larger flow rate than the flow rate indicating the peak efficiency. In the conventional straight discharge section shape, the efficiency tends to decrease as the flow rate increases. However, in this embodiment, this point is improved.

When the tongue section 30 is located at the central portion of the second flow passage section F2 or on the downstream side of the central portion, the position of the tongue section 30 becomes farther than the representative cross section. A, and the aforementioned effect can be more remarkably exhibited.

When the angle formed between the outer wall section 24 which is the wall surface of the tongue section 30 on the side of the scroll flow passage 21 and the outer wall section 25 which is the wall surface of the tongue section 30 on the side of the discharge flow passage 22 is formed to be 50° or more, by smoothly connecting the diffuser flow passage (scroll flow passage) and the discharge flow passage, for example, disturbance of the flow flowing in from the diffuser flow passage is reduced, and the aforementioned effect can be more remarkably exhibited.

Figure 10A:
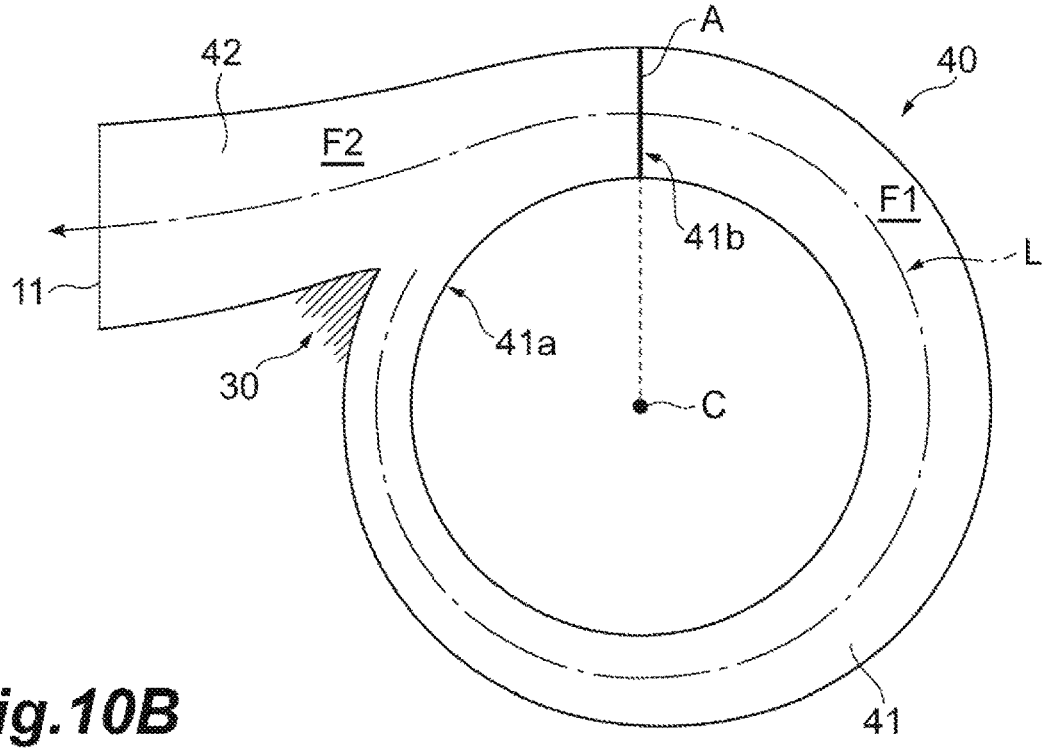
FIG. 10A is a diagram illustrating an external form of a compressed gas flow passage according to a modified example.

Although the embodiments of the present disclosure have been described above, the present invention is not limited to the above embodiments. For example, various modified aspects illustrated in FIG. 10 may be adopted. As illustrated in FIG. 10A, even when the position of the discharge port 11 is set to be low in the Y direction with respect to the representative cross section A, it is possible to adopt a compressed gas flow passage 40 which includes a scroll flow passage 41 extending from a winding start section 41*a* to a winding finish section 41*b*, and a discharge flow passage 42 connected to the scroll flow passage 41. On the downstream side of the representative cross section A, a gently curved second flow passage section F2 is formed, and the tongue section 30 facing the second flow passage section F2 is located in the middle of the second flow passage section F2.

Figure 10B:
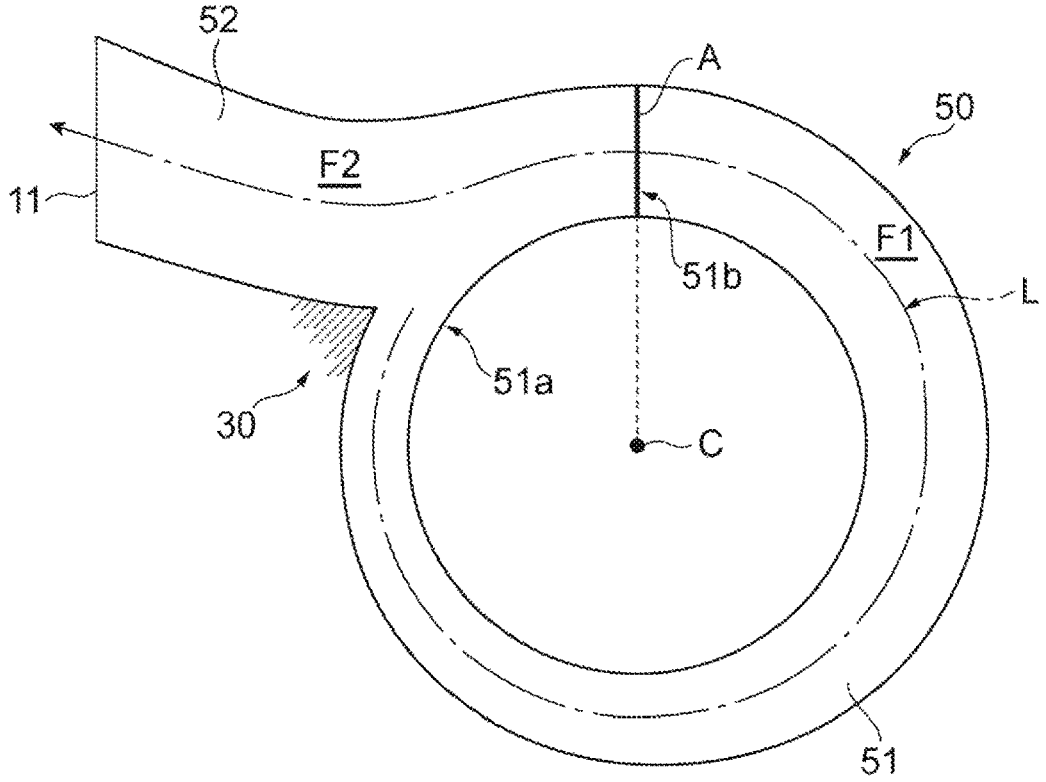
FIG. 10B is a diagram illustrating an external form of a compressed gas flow passage according to another modified example.

As illustrated in FIG. 10B, even when the position of the discharge port 11 is set to be higher than the representative cross section A in the Y direction, it is possible to adopt a compressed gas flow passage 50 which includes a scroll flow passage 51 extending from a winding start section 51*a* to a winding finish section 51*b*, and a discharge flow passage 52 connected to the scroll flow passage 51. A second flow passage section F2 is formed on the downstream side of the representative cross section A, and the tongue section 30 facing the second flow passage section F2 is located in the middle of the second flow passage section F2.

Even with such compressed gas flow passages 40 and 50, the same operation and effect as illustrated in FIG. 8A are exhibited.

The first flow passage section F1 and the second flow passage section F2 are not limited to a case where they are continuous. A straight flow passage section may be provided over a predetermined length between the first flow passage section F1 and the second flow passage section F2. In this case, there is no inflection point, and the first flow passage section F1 and the second flow passage section F2 communicate with each other by the straight flow passage section.

The shape of the discharge port is not limited to the case of extending in the substantially circumferential direction of the scroll flow passage. For example, a shape curved in a paper surface direction may be provided. In this case, for example, on the basis of the shape projected on the cross section cut along the plane orthogonal to the central axis passing through the origin C, similarly to the above-described embodiment, it is possible to adopt a scroll flow passage which includes a scroll flow passage extending from the winding start section to the winding finish section, and a discharge flow passage connected to the scroll flow passage.

The present invention is not limited to the turbocharger 1, and can be applied to any centrifugal compressor. Further, as viewed from the suction port 9 of the centrifugal compressor 3, winding of the scroll flow passage is not limited to the case of being formed from the winding start section to the winding finish section in a clockwise direction. For example, as viewed from the suction port 9, a spiral of the scroll flow passage may be formed from the winding start section to the winding finish section in a counterclockwise direction.

INDUSTRIAL APPLICABILITY

According to some aspects of the present disclosure, it is possible to suppress the flow of gas from colliding with the tongue section, and as a result, it is possible to reduce the loss and to suppress the decrease in efficiency in the discharge section.

REFERENCE SIGNS LIST

1 turbocharger
3 compressor (centrifugal compressor)
20 compressed gas flow passage
21 scroll flow passage
22 discharge flow passage
23 inner wall section
24 outer wall section
25 outer wall section
26 inner wall section
30 tongue section
40 compressed gas flow passage
41 scroll flow passage
42 discharge flow passage
50 compressed gas flow passage
51 scroll flow passage
52 discharge flow passage
C origin
F1 first flow passage section
F2 second flow passage section
L center line

The invention claimed is:

1. A discharge section structure for a centrifugal compressor provided with a scroll flow passage and a discharge flow passage connected to a discharge side of the scroll flow passage, the discharge section structure comprising:

a tongue section provided in a branching section between the scroll flow passage and the discharge flow passage;

a first flow passage section having a first center of curvature on an origin side of the scroll flow passage, the first flow passage section including a first inner wall section and a first outer wall section each with respect to the first center of curvature; and a second flow passage section communicating with the discharge side of the first flow passage section and having a second center of curvature outside of the scroll flow passage, the second flow passage section including a second inner wall section and a second outer wall section each with respect to the second center of curvature, wherein the first flow passage section includes at least a part of the scroll flow passage, the second flow passage section includes at least a part of the discharge flow passage, the tongue section faces the second flow passage section and is located upstream of the part of the discharge flow passage, and the second flow passage section includes a convex shape formed by the second outer wall section and an imaginary surface extending from an upstream end of the second outer wall section to the first inner wall section, wherein the convex shape extends continuously in an upstream direction from a downstream end of the second flow passage section to an end of the imaginary surface at the first inner wall section.

2. The discharge section structure for the centrifugal compressor according to claim 1, wherein the tongue section is located at a central portion of the second flow passage section or on a downstream side of the central portion.

3. The discharge section structure for the centrifugal compressor according to claim 1, wherein, in a cross section orthogonal to a central axis passing through the origin of the scroll flow passage, an angle formed between a wall surface of the tongue section on the scroll flow passage side and a wall surface of the tongue section on the discharge flow passage side is 50° or more.

4. The discharge section structure for the centrifugal compressor according to claim 2, wherein, in a cross section orthogonal to a central axis passing through the origin of the scroll flow passage, an angle formed between a wall surface of the tongue section on the scroll flow passage side and a wall surface of the tongue section on the discharge flow passage side is 50° or more.

5. The discharge section structure for the centrifugal compressor according to claim 1, wherein the at least the part of the discharge flow passage is included in the convex shape.

6. The discharge section structure for the centrifugal compressor according to claim 1, wherein the imaginary surfaces passes through a front end of the tongue section.

* * * * *